US007052322B2

(12) United States Patent
Hu et al.

(10) Patent No.: US 7,052,322 B2
(45) Date of Patent: May 30, 2006

(54) STACKED ELECTRICAL CONNECTOR

(75) Inventors: Jinkui Hu, Kunsan (CN); Guohua Zhang, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,332

(22) Filed: Dec. 28, 2004

(65) Prior Publication Data

US 2005/0181671 A1 Aug. 18, 2005

(30) Foreign Application Priority Data

Feb. 17, 2004 (CN) ..... 2004 2 00248136

(51) Int. Cl.
*H01R 13/60* (2006.01)

(52) U.S. Cl. ..... 439/607

(58) Field of Classification Search ..... 439/607, 439/540.1

See application file for complete search history.

(56) References Cited

U.S. PATENT DOCUMENTS

| | | | | |
|---|---|---|---|---|
| 5,755,595 | A | 5/1998 | Davis et al. | |
| 5,797,770 | A | 8/1998 | Davis et al. | |
| 6,113,428 | A | 9/2000 | Yeh | |
| 6,139,367 | A | 10/2000 | Yeh | |
| 6,238,244 | B1 * | 5/2001 | Yang | 439/607 |
| 6,364,707 | B1 * | 4/2002 | Wang | 439/607 |

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical connector (1) includes an insulative housing (10), a number of contacts (20) received in the housing, an inner shell (30) and an outer shell (40) covering the housing. The housing defines a partition (13) extending forwardly. The outer shell defines a pair of concaves (46) and a pair of resilient grounding tabs (411) extending upwardly therefrom for contacting with a metal panel of a personal computer to establish ground connections. The inner shell surrounds the partition with a pair of tangs (33) engaging in the concaves of the outer shell.

20 Claims, 7 Drawing Sheets

STACKED ELECTRICAL CONNECTOR

BACKGROUND OF THE INVENTION

1. Field of the Invention

The present invention relates to an electrical connector, and particularly to a stacked electrical connector mounting on a printed circuit board.

2. Description of Prior Arts

U.S. Pat. No. 6,139,367 discloses a stacked electrical connector, which has an insulative housing, a number of contacts received in the housing, two inner shells and an outer shell covering the housing. The housing defines an isolator thereon extending forwardly. The outer shell defines outwardly curved plates extending forwardly from front edges thereof for contacting with a metal panel of a personal computer to establish ground connections. The inner shell surrounds the isolator with a pair of tangs engaging with the outer shell and a pair of tabs extending forwardly for contacting with the metal panel of the personal computer.

However, with the ever-increasing miniaturization and compaction of computer and other electronic equipment, protruding elements around the interface of the mating connector, like the outwardly curved plates, tabs and tangs of the above-mentioned patent, would occupy space unnecessarily, and trouble a high-precise assembly and frequent using of the electrical connector.

Hence, it is desirable to have an improved electrical connector to overcome the above-mentioned disadvantages of the prior art.

SUMMARY OF THE INVENTION

An object of the present invention is to provide a compact stacked electrical connector for mounting on a printed circuit board.

To achieve the above object, an electrical connector in accordance with the present invention includes an insulative housing, a number of contacts received in the housing, an inner shell and an outer shell covering the housing. The housing defines a partition thereon extending forwardly. The outer shell defines a pair of concaves and a pair of grounding tabs extending upwardly therefrom for contacting with a metal panel of a personal computer to establish ground connections. The inner shell surrounds the partition with a pair of tangs engaging in the concaves of the outer shell.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
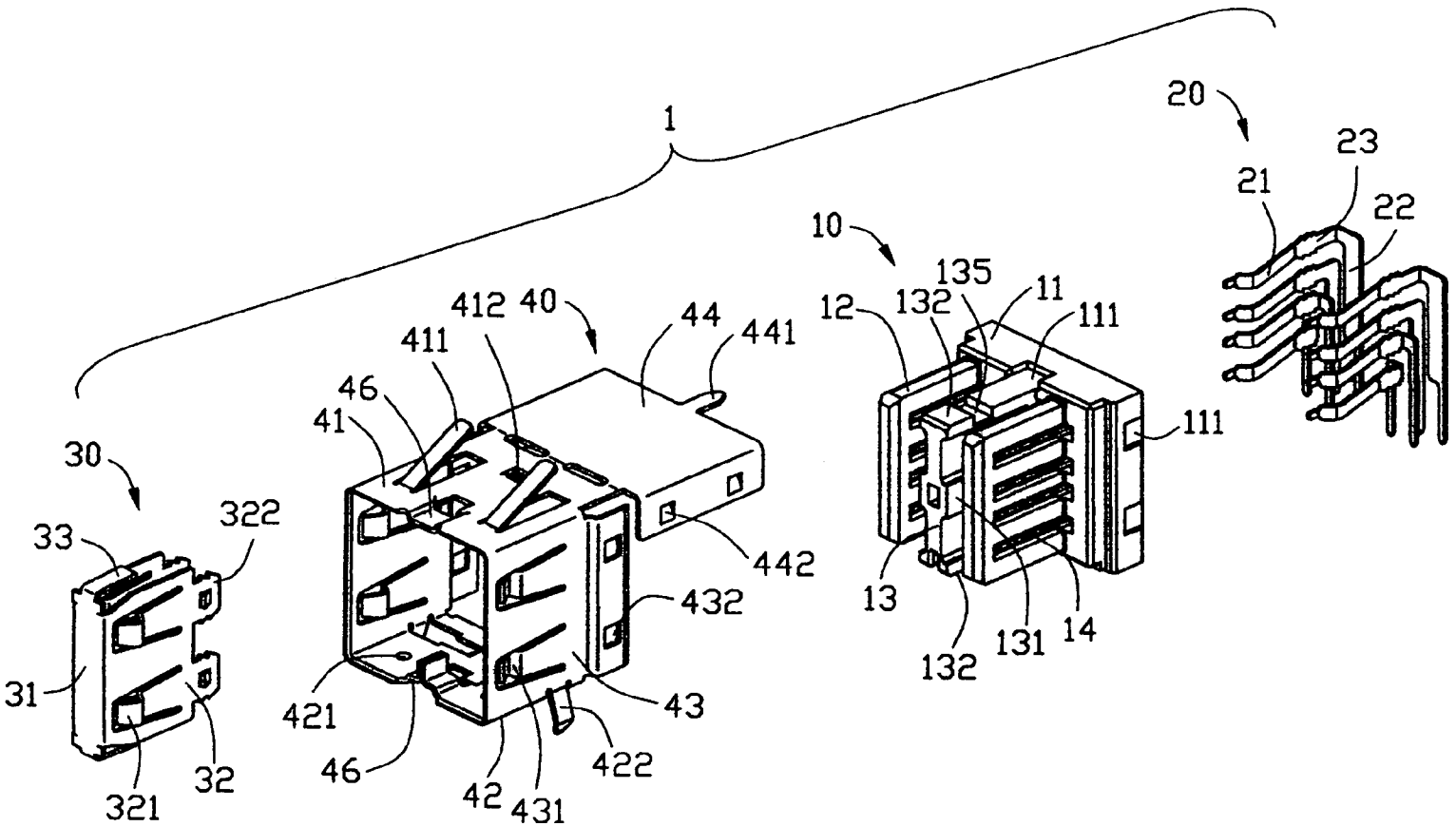
FIG. 1 is an exploded, perspective view of an electrical connector in accordance with the present invention.
Figure 2:
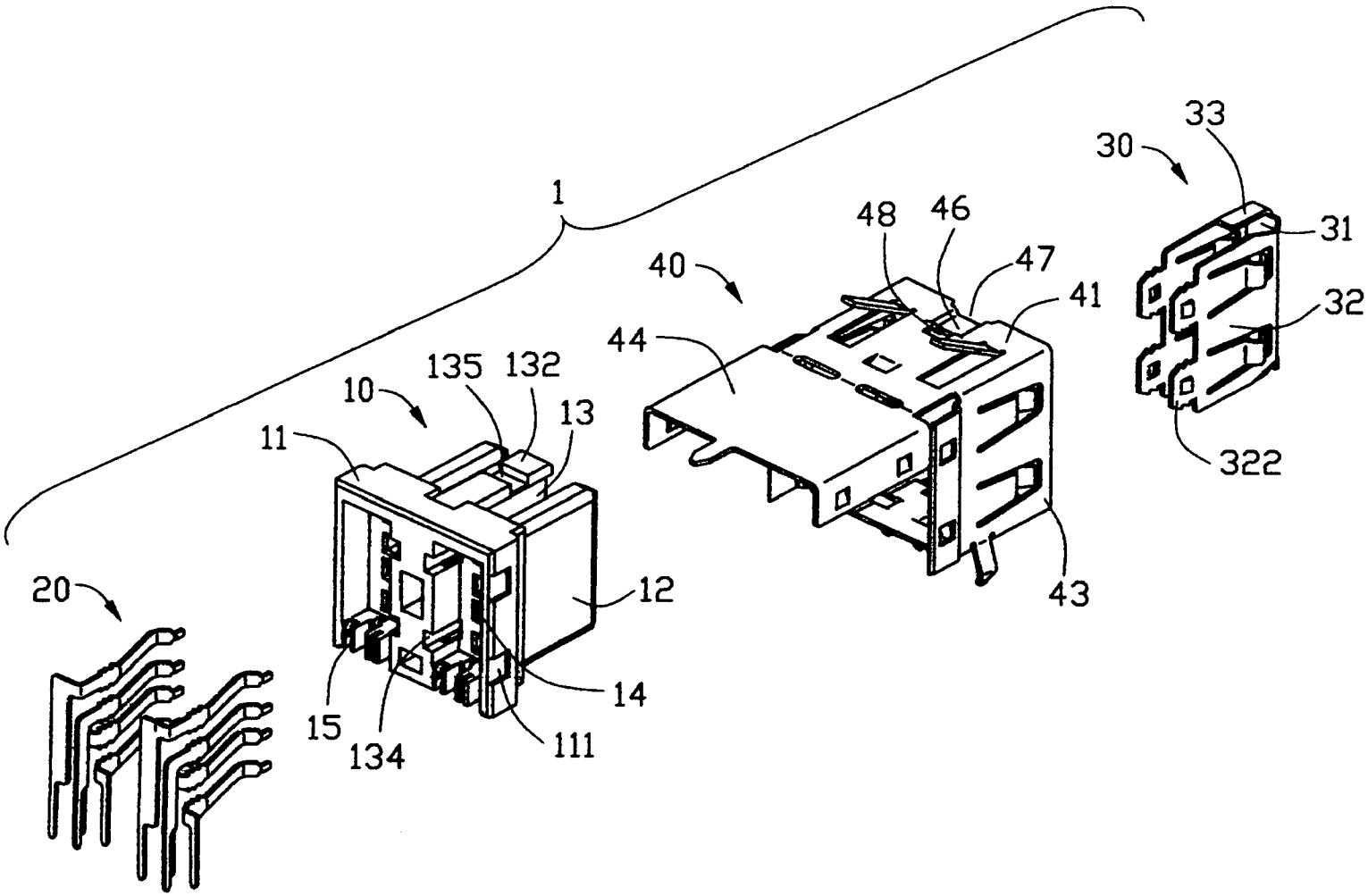
FIG. 2 is a view similar to FIG. 1, but taken from a different aspect.
Figure 3:
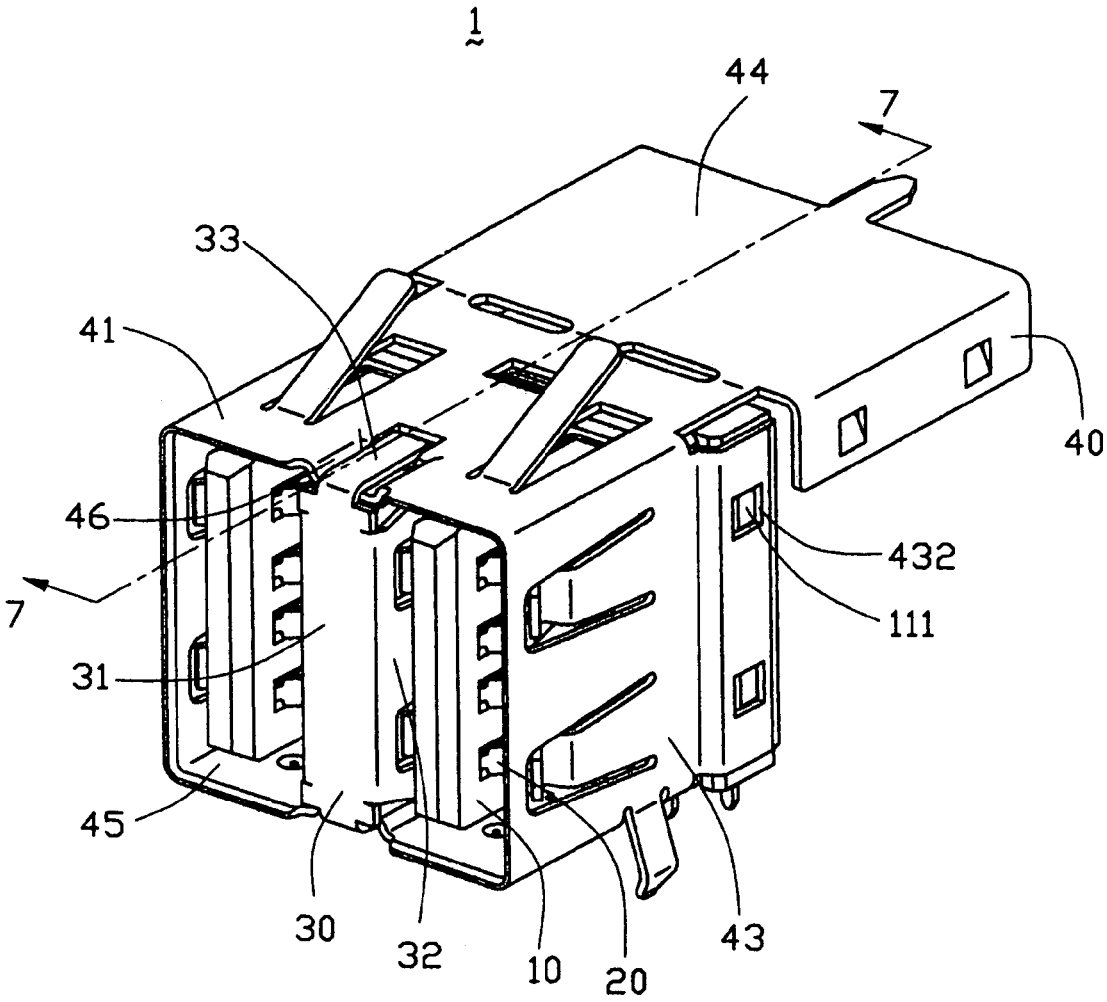
FIG. 3 is a perspective view of the electrical connector of FIG. 1.
Figure 4:
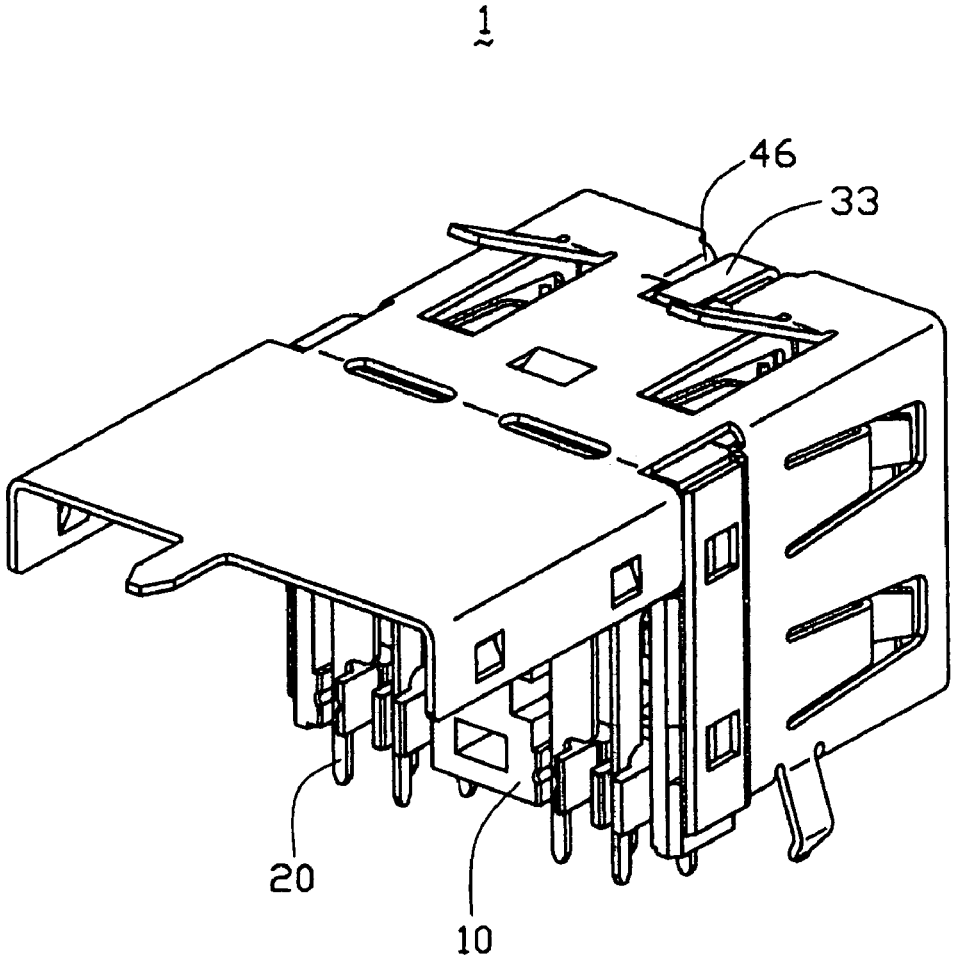
FIG. 4 is a view similar to FIG. 3, but taken from a different aspect.
Figure 5:
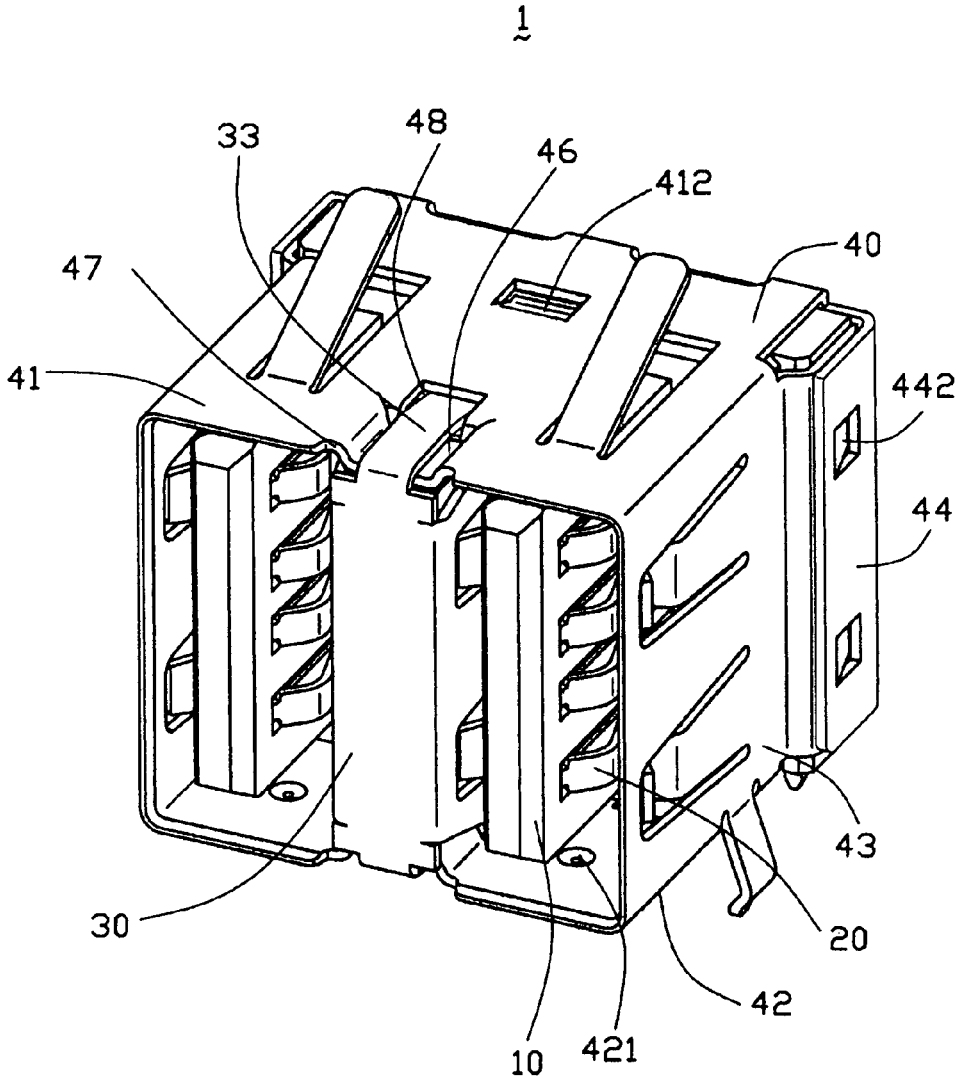
FIG. 5 is a perspective view of the electrical connector of FIG. 3, wherein a rear wall of an outer shell covers a rear of an insulative housing.

Referring to FIGS. 1 to 5, an electrical connector 1 for mounting on a printed circuit board (now shown) in accordance with the present invention comprises an insulative housing 10, a plurality of contacts 20, an inner shell 30 and an outer shell 40. In a preferred embodiment, the electrical connector 1 is typical a USB (University Serial Bus) connector. However, in alternative embodiments, the electrical connector could be provided as other types.

The housing 10 comprises a substantial rectangular base portion 11, two tongue portions 12 extending forwardly from the base portion 11, a partition 13 extending forwardly from base portion 11 and located between the two tongue portions 12, a plurality of passageways 14 extending through the base portion 11 into tongue portions 12, and a plurality of slots 15 located at a rear thereof. The base portion 11 defines a plurality of positioning recesses 111 on a top and opposite sides thereof. The tongue portions 12 and the partition 13 are parallel to each other, and the partition 13 defines a pair of opposite side surfaces 131 facing to corresponding tongue portions 12, respectively. The partition 13 further defines a pair of opposite edges 132 connecting the side surfaces 131. Each edge 132 defines a cavity 135 therein.

The contacts 20 are received in the passageways 14 of the housing 10 and each contact 20 comprises a contact portion 21, a tail portion 22 and a housing retaining portion 23 connecting the contact portion 21 and the tail portion 22. The contact portions 21 expose outside the tongue portion 12 for electrical connecting with contacts of a complementary connector (not shown). The tail portions 22 extend downwardly through the slots 15 of the housing 10 for electrical connecting with the printed circuit board. The housing retaining portions 23 are secured within the passageways 14 of the housing 10 by an interference fit.

Figure 6:
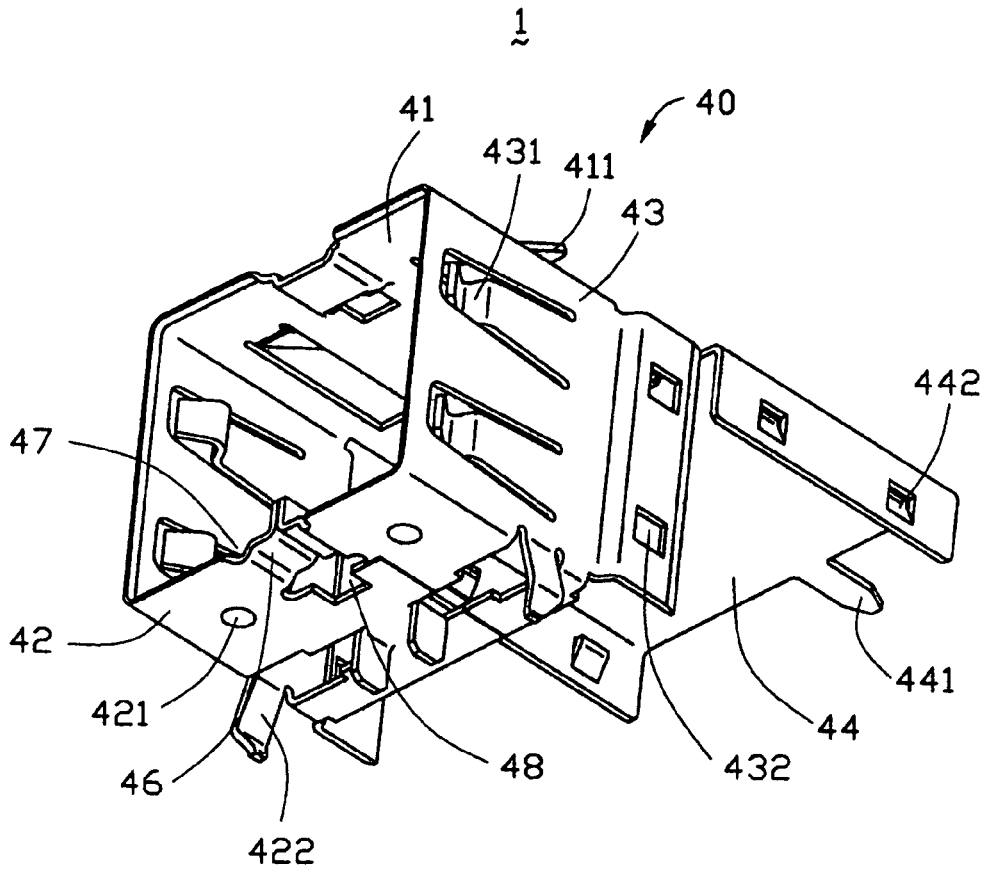
FIG. 6 is an enlarged view of an inner shell shown in FIG. 1.

Further referring to FIG. 6, the outer shell 40 covers the housing 10 and defines a receiving space 45 therein, which is divided into two parts by the partition 13 of the housing 10. The outer shell 40 comprises a top wall 41, a bottom wall 42 opposite to the top wall 41, a pair of opposite side walls 43 connecting the top and bottom walls 41, 42 and a rear wall 44 extending rearwardly from the top wall 41. The top wall 41 defines two resilient grounding tabs 411 for contacting with a panel of an external electrical element (not shown) and a positioning tab 412 engaging with the positioning recess 111 on the top of the housing 10. The bottom wall 42 defines a plurality of retaining contacts 422 arranged in a line on a rear section thereof for retaining the electrical connector on the printed circuit board and a pair of protrusions 421 on a front section thereof for standoff. Each side wall 43 defines two resilient arms 431 formed therein for contacting with the shielding of complementary connector and two positioning opening 432. The rear wall 44, which is turned to cover the rear of the housing during assembly, defines a retaining tab 441, and positioning tabs 442 on opposite sides thereof extending through positioning opening 432 and engaging with positioning recesses 111 of the housing 10 (FIG. 10). The outer shell 40 further defines a pair of concaves 46, a pair of cutouts 47 and a pair of opening 48 oppositely located on the top and bottom walls 41, 42, respectively. Each cutout 47 is defined in front edge of the outer shell 40, and each concave 46 is defined between and communicating with corresponding cutouts 47 and opening 48.

Figure 7:
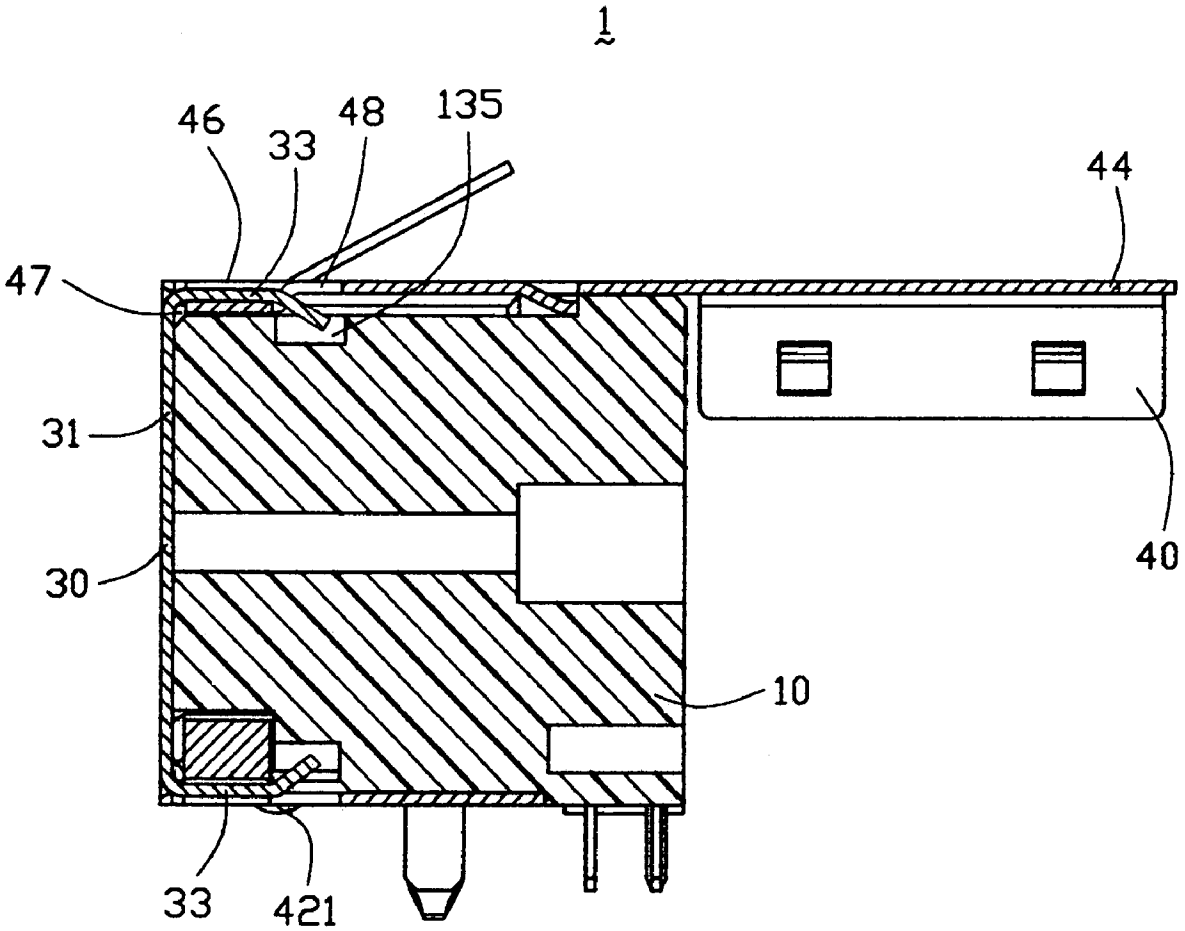
FIG. 7 is a cross-sectional view taken along line VII—VII of FIG. 3.

The inner shell 30 has a clamping shape, surrounds the partition 13 of the housing and comprises a middle plate 31 and two side plates 32 extending from opposite edges of the middle plate 31. Each side plate 32 covers the side surface 131 of the partition 13, and includes two resilient arms 321 formed therein for contacting with the shielding of complementary connector and two retaining finger 322 extending into the housing. A pair of engaging tangs 33 extend substantially along the same extended direction of the side plate 32 from two ends of the middle plate 31. Each tang 33 extends through corresponding cutout 47, concave 46 and opening 48 and finally into corresponding cavity 135 (FIG. 7).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for mating with a complementary connector comprising:

an insulative housing comprising a base portion and a partition extending from the base portion;

a plurality of contacts receiving in the housing;

an outer shell covering the housing, and defining a receiving space therein divided into two parts by the partition and a pair of concaves located oppositely; and an inner shell surrounding the partition of the housing and having a pair of tangs engaging with the outer shell in the concaves.

2. The electrical connector as described in claim 1, wherein the outer shell further defines a pair of cutouts oppositely located in front edges thereof and communicating with corresponding concaves, the tangs of the inner shell extending through the cutouts.

3. The electrical connector as described in claim 1, wherein the outer shell further defines a pair of openings located oppositely and communicating with corresponding concaves, the tangs of the inner shell extending into the openings.

4. The electrical connector as described in claim 3, wherein the partition of the housing defines a pair of cavities in opposite edges thereof, the tangs extending through the openings into the cavities.

5. The electrical connector as described in claim 1, wherein the partition of the housing defines a pair of side surfaces facing the receiving space, and the inner shell defines a pair of side plates covering corresponding side surfaces, respectively.

6. The electrical connector as described in claim 5, wherein each side plate defines two resilient tabs for contacting with a shielding of the complementary connector.

7. The electrical connector as described in claim 1, wherein the outer shell defines a top wall and the top wall defines a pair of resilient grounding tabs.

8. The electrical connector as described in claim 1, wherein the outer shell defines a bottom wall, the bottom wall defines a plurality of retaining contacts arranged in a line on a rear section.

9. The electrical connector as described in claim 8, wherein the bottom wall of the outer shell defines a pair of protrusions.

10. A dual-port electrical connector assembly comprising:

an insulative housing comprising a base portion and a partition extending from the base portion;

a plurality of contacts receiving in the housing;

an outer shell covering the housing, and defining therein a receiving space divided into two parts by the partition, and at least one concave structure located against a side edge of said partition; and an inner shell surrounding the partition of the housing and having at least one tang engageably received within the concave structure; wherein the tang is essentially flush with a corresponding outer surface of the outer shell beside said concave structure.

11. The assembly as claimed in claim 10, wherein contact tails extend downwardly below said outer surface for mounting to a printed circuit board.

12. The assembly as claimed in claim 10, an opening is formed in the outer shell behind said concave structure, and said tang extends into said opening for securing said outer shell and said inner shell together.

13. The assembly as claimed in claim 12, wherein said partition further includes a recess in alignment with said opening, and said tang further extends into said recess for securing both said outer shell and said inner shell to said housing.

14. The assembly as claimed in claim 10, wherein another concave structure is formed in the outer shell and engaged with the other side edge of the partition.

15. The assembly as claimed in claim 14, wherein the inner shell further includes another tang engageably received in said another concave structure.

16. A dual-port electrical connector assembly comprising:

an insulative housing comprising a base portion defining a front-to-back direction, a lateral direction and a thickness direction perpendicular to one another, and a partition extending forwardly from the base portion, a dimension of said partition in said lateral direction being smaller than that of the base portion;

a pair of tongues extending forwardly from the base portion by two sides of the partition;

a plurality of contacts receiving in the housing;

an outer shell covering the housing, and defining therein a receiving space divided into two parts by the partition to receive the corresponding tongues, and at least one concave structure located against a side edge of said partition in said lateral direction while other portions of the outer shell being spaced from the tongues in said lateral direction; and an inner shell surrounding the partition of the housing and having at least one tang engageably received within the concave structure.

17. The assembly as claimed in claim 16, wherein the partition is dimensionally larger than said tongues in said lateral direction.

18. The assembly as claimed in claim 16, wherein said concave structure is located in one face of the outer shell, beyond which tails of the contacts downward extend for mounting to a printed circuit board.

19. The assembly as described in claim 16, wherein the side edge of said partition defines a cavity in which the tang is received.

20. The assembly as described in claim 19, wherein said outer shell defines an opening around said concave through which said tang extends into said cavity.

* * * * *